US008381989B2

(12) United States Patent
O'Neill

(10) Patent No.: US 8,381,989 B2
(45) Date of Patent: Feb. 26, 2013

(54) WEARABLE DEVICE WITH A MANIPULATABLE OBJECT

(76) Inventor: Rosemary O'Neill, Arlington, VA (US)

( * ) Notice: Subject to any disclaimer, the term of this patent is extended or adjusted under 35 U.S.C. 154(b) by 358 days.

(21) Appl. No.: 12/908,706

(22) Filed: Oct. 20, 2010

(65) Prior Publication Data

US 2012/0097719 A1 Apr. 26, 2012

(51) Int. Cl.
*G06K 19/00* (2006.01)

(52) U.S. Cl. ..... 235/487; 63/31

(58) Field of Classification Search ..... 235/487; 63/31

See application file for complete search history.

(56) References Cited

U.S. PATENT DOCUMENTS 2,653,402 A * 9/1953 Bonagura ..... 40/662
3,242,690 A * 3/1966 Kettell ..... 63/29.1
3,273,766 A * 9/1966 Cosentino ..... 224/197
4,187,697 A * 2/1980 Castelo ..... 63/31
4,305,262 A * 12/1981 Ferrara ..... 63/29.1
4,551,993 A * 11/1985 Nagahori ..... 63/31
4,674,749 A 6/1987 Shaffer et al.
4,763,821 A 8/1988 Powell
4,905,881 A 3/1990 Graber
4,989,420 A * 2/1991 Reinhold et al. ..... 63/15
5,704,067 A 1/1998 Brady
5,738,624 A 4/1998 Zablotsky et al.
5,782,743 A 7/1998 Russell
5,896,757 A * 4/1999 Kharloubian ..... 63/31
6,065,971 A * 5/2000 Lennon ..... 434/246
6,146,324 A 11/2000 Engel
6,306,076 B1 10/2001 Gill
D450,009 S * 11/2001 Molfese ..... D11/26
6,425,137 B1 7/2002 Fakhrai
6,443,341 B1 9/2002 Rittmann
6,560,993 B1 * 5/2003 Bosque et al. ..... 63/3
6,561,415 B2 5/2003 Grant
6,634,548 B1 10/2003 Bowman
6,688,139 B2 * 2/2004 Tschetter ..... 63/31
D533,476 S * 12/2006 Jang ..... D11/26
7,313,929 B2 1/2008 Lazor
7,614,434 B2 11/2009 DeMichele

* cited by examiner

*Primary Examiner* — Daniel Hess
(74) *Attorney, Agent, or Firm* — WRB-IP LLP

(57) ABSTRACT

A wearable device includes pliable material at least partially forming a track and a loop. An object is disposed on the track and is adapted to be manipulated along the track.

20 Claims, 10 Drawing Sheets

WEARABLE DEVICE WITH A MANIPULATABLE OBJECT

BACKGROUND AND SUMMARY

The invention relates to a wearable device with an object capable of being manipulated along a track forming part of the device.

A variety of devices are known that may be worn around various parts of the body, such as around the wrist. The devices can include various therapeutic or other articles such as magnets that can be placed on or inside the device.

Wearable counting devices are also known. Often, these devices are designed for a particular purpose such as keeping score in a tennis match or counting a number of calories consumed.

The inventor has recognized that it is useful for a wearable device to have a manipulatable object. Manipulation of the object may be useful for, e.g., therapeutic purposes. The inventor has also recognized that it is useful to provide a wearable device that can be used as a game, or that can be used to allow a user to track factors of a game with a movable object.

According to one aspect of the invention, a wearable device comprises one or more pieces of pliable material at least partially forming a generally tubular track and a generally cylindrical loop, wherein the track is partially closed at one or more locations by one or more closure lines, and an object disposed in the track and adapted to be manipulated through the track around the one or more closure lines.

According to another aspect of the invention, a wearable device comprises a loop, the loop at least partially forming a track, the track being separated into a plurality of labeled sections, and an object externally and movably mounted on the track, the object being movable to each of the labeled sections.

According to yet another aspect of the invention, a wearable device comprises a first loop at least partially forming a track, an object on the track and adapted to be manipulated along the track, and a second loop, the second loop having a plurality of openings, the first loop being woven through the plurality of openings.

DETAILED DESCRIPTION

Figure 1A:
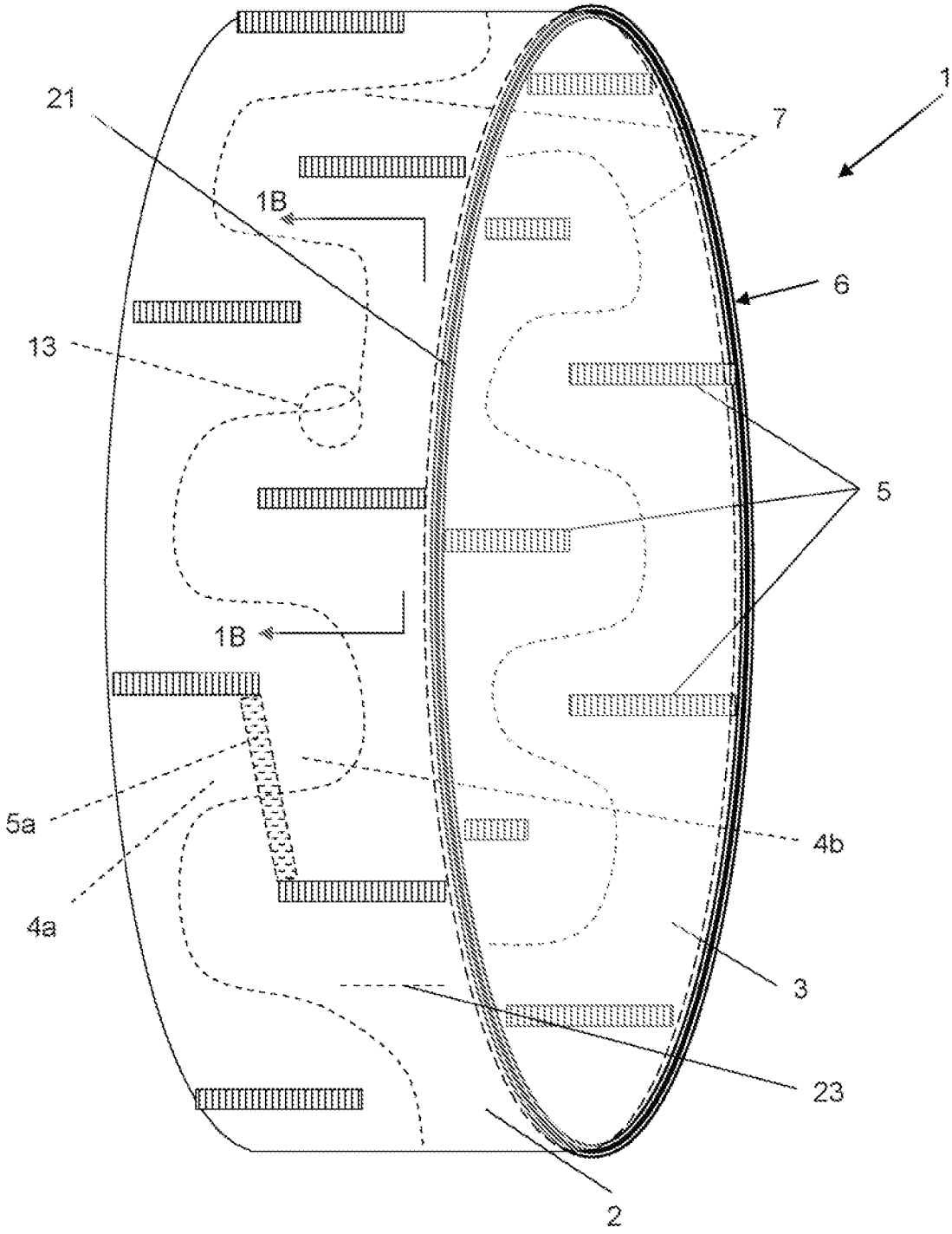
FIG. 1A schematically shows a wearable device according to an aspect of the invention.

A wearable device 1 according to an aspect of the invention is shown in FIG. 1A. The wearable device 1 is made of two layers 2 and 3 of pliable material, such as a felt fabric. The layers 2 and 3 define a tube that may be formed by material that has been, for example, formed in a tube-shape, formed by a single, folded piece of material with the open end opposite the fold closed by, for example, stitching 21, or formed by two or more separate pieces of material placed on top of each other and stitched or otherwise secured together. The layers 2 and 3 form a closed path or track 7 (shown in phantom) which is further formed into a loop 6, such as by sewing or bonding together ends of the tube formed by the layers. The loop 6 may be an endless loop as illustrated, or a C-shaped loop having ends that do not meet. The endless loop 6 may have an internal track 7 that is or is not endless.

The device 1 is intended to be worn around a person's limb, such as in the manner of a bracelet. The device 1 of FIG. 1A forms a loop 6 that is generally cylindrical, in the sense that it has a significant dimension in the direction of an opening defined by the loop, the dimension being substantially greater than the thickness of the layers 2 and 3 of material. It is intended that the expression "generally cylindrical" encompass endless and C-shaped loops.

Figure 1B:
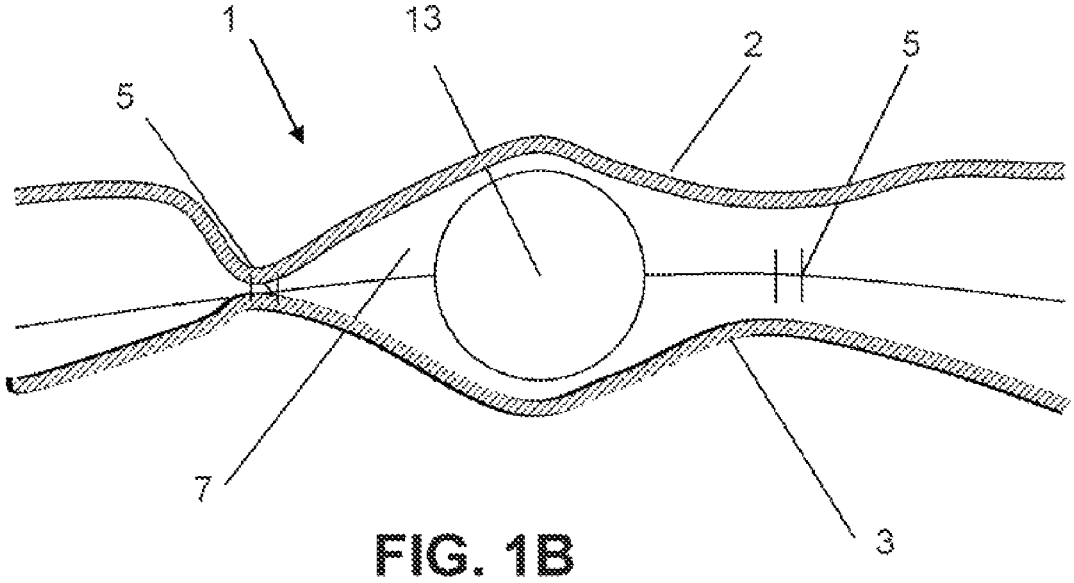
FIG. 1B is a cross-sectional view of the wearable device of FIG. 1A taken at section 1B-1B.

The track 7 can be partially closed at one or more locations by closure lines 5, such as lines of stitching or seams formed by heat sealing, adhesive, or the like, that form obstacles, curves, pockets, or other shapes (herein generically referred to as "pockets") in the track. The track 7 is designed so that an object 13 such as a marble, a bead, a stone, or other item can be pushed, nudged, squeezed or otherwise manipulated along the track 7 between the layers 2 and 3 as seen in FIG. 1B and around the closure lines 5 as seen in FIG. 1A. The closure lines 5 can be provided in a variety of random or repeating, patterned arrangements. The closure lines may be arranged to provide two or more separate or connected pathways around the loop. The object 13 can ordinarily be manipulated in any direction allowed by the pattern of the track 7. The object 13 may be manipulated along the track 7 while the wearable device 1 is being worn or when the wearable device 1 has been removed from the wearer's body. It may be manipulated by using one hand or by using two hands. One or more slits 23 (shown in phantom) may be provided in one or both of the layers 2 and 3 to permit introducing and removing the object. The track 7 may be filled with a material that impedes or facilitates movement of the object, such as buckwheat hulls, oil, gel, and the like.

The object 13 may be in the form of any solid or substantially solid article or substance that is capable of being manipulated along the track 7. The object 13 may be made of any of a variety of materials, as well as of plural different materials, and may have any desired texture. The object 13 may be visible through the material, such as by providing an object that is sufficiently bright or luminous to be entirely or partially visible through the material forming the layers 2 and 3, and/or by providing transparent or not completely opaque material. The object 13 may also emit a sound that is audible through the material. Thus, senses including but not limited to sight, touch, and sound may be used to determine the location of the object 13.

The track 7 can be a continuous, i.e., endless track 7, in which the object 13 can be manipulated continuously in either direction around the track 7 without running into an impassable closure line. Alternatively, the track 7 may have defined first and second ends 4*a* and 4*b* such as might be provided by an impassable closure line 5*a* as seen in phantom in FIG. 1.

Figure 2:
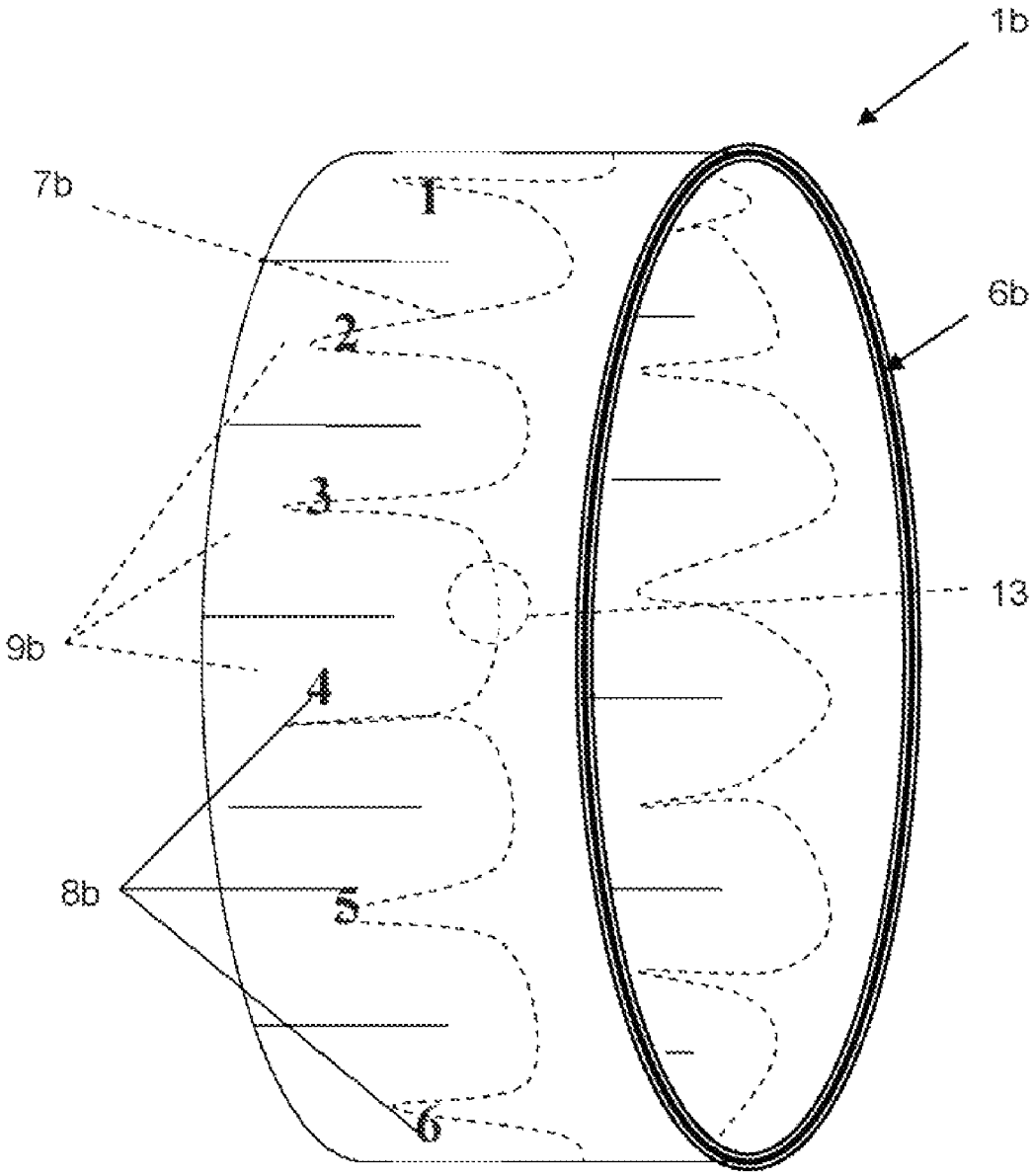
FIG. 2 schematically shows a wearable device according to a second aspect of the invention.

In the embodiment of FIG. 2, the track 7*b* (shown in phantom) may be formed in the loop 6*b* of the wearable device 1*b* so that it defines a plurality of sections or internal pockets or chambers 9*b* (shown in phantom). Each section 9*b* may be further defined by one or more of a plurality of labels 8*b* corresponding to the section 9*b*. The sections 9*b* can be distinguished by a variety of labels 8*b* in a variety of non-limiting forms such as different colors, different textures or different symbols, such as numbers or letters. The illustrated embodiment of FIG. 2, for example, shows sections 9*b* distinguished by labels 8*b* in the form of numerical symbols.

The sections 9*b* may be used for counting, tracking a factor within a game or other purposes. The expression "factors within a game" is meant to refer to, for example, a score, a level, or any other element or characteristic that may be important to track during game play. For example, a game may be based on moving the object 13 through a maze-like track 7*b* on the wearable device 1*b*. The wearable device 1*b* might also be used to keep a score or to count, such as by putting the object 13 in a particular labeled section 9*b* to reflect a score in a game or to count for some other purpose. The sections 9*b* may include portions of a two-directional track 7*b* or they may include pocketed or chambered sections that are connected to an otherwise two-directional track as illustrated in FIG. 2.

Figure 3:
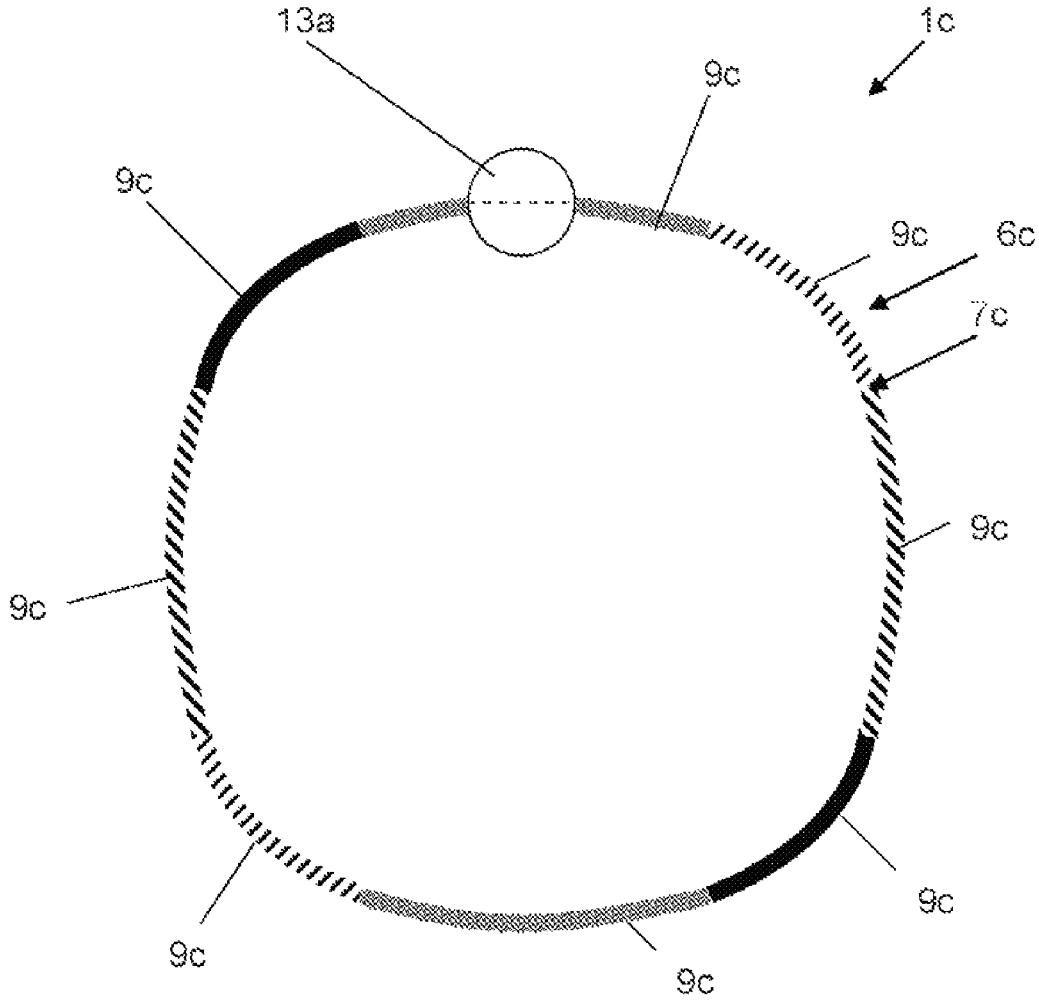
FIG. 3 schematically shows a wearable device according to a third aspect of the invention.

In an aspect of the invention shown in FIG. 3, the wearable device 1*c* may be formed by one or more pieces of pliable material formed into a loop 6*c* that also functions as the track 7*c* for an object 13*a* attached to the loop 6*c*. The wearable device 1*c* may also have starting points and ending points, such as bulges, knots, or the like (not shown) in the material, inhibiting manipulation of the object 13*a*.

Further regarding FIG. 3, an object 13*a* can be manipulated along the track 7*c*. The object 13*a* can be attached to the track 7*c* in a variety of suitable ways. For example the object 13*a* may be in the form of a bead with an opening extending through it that is sufficiently large to allow the loop 6*c* to pass through the opening in a compressed state but, when the loop expands, friction between the loop and the surface of the opening holds the object in place unless the object is pushed or pulled with sufficient force to overcome friction between the loop and the surface of the opening. The grip of the object 13*a* will be loose enough to allow the object 13*a* to be manipulated along the track 7*c* when adequate force is applied. A gripping mechanism may include a portion of the object 13*a* that may be mechanically (or otherwise) altered to increase or reduce the friction between the object 13*a* and the track 7*c*. A mechanical gripping mechanism that operates in the manner of vise or an elastic band, for example, may be used as a gripping mechanism.

The track 7*c* of the wearable device 1*c* is divided into discrete, identifiable sections 9*c* defined by labels. Like the sections 9*b* of the closed track 7*b* in FIG. 2, the sections 9*c* of FIG. 3 can be distinguished in a variety of non-limiting ways such as color, texture or symbols. The embodiment shown in FIG. 3, for example, shows sections 9*c* distinguished by labels in the form of different colors or shades. The sections 9*c* may be used for counting, tracking a factor within a game or other purposes.

Figure 4A:
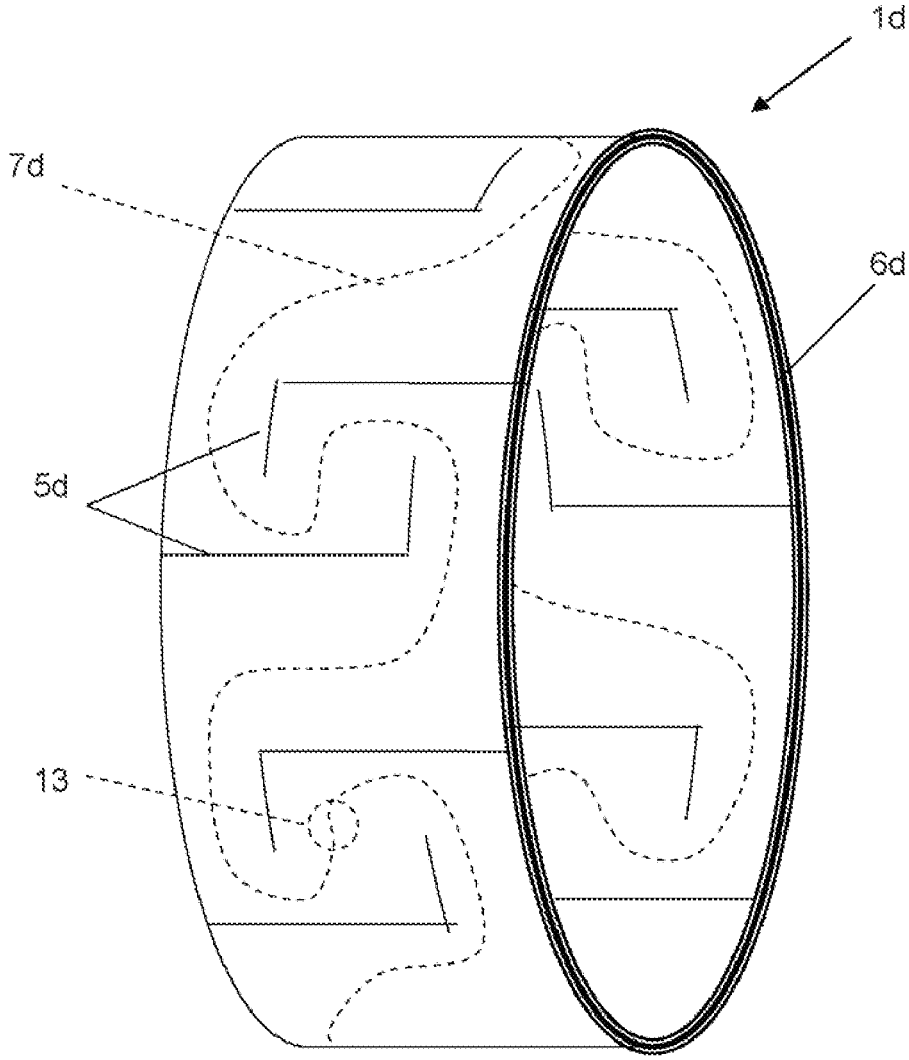
FIGS. 4A-4D schematically show a wearable device according to a fourth aspect of the invention.
Figure 4B:
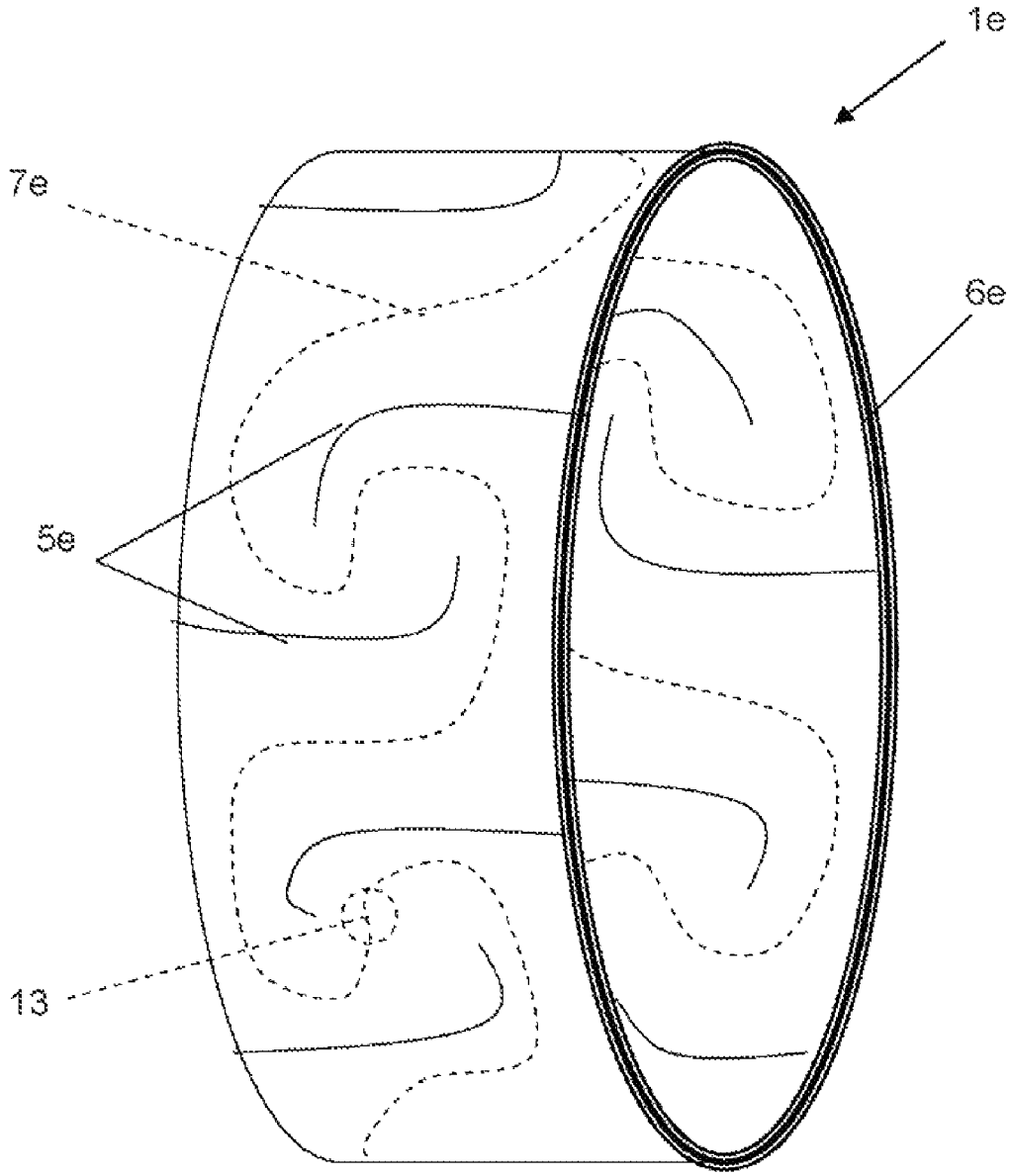
Figure 4C:
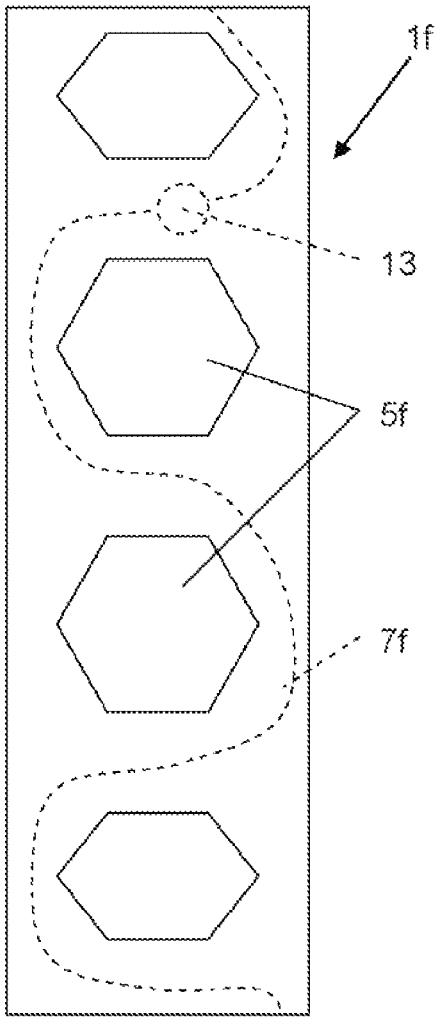
Figure 4D:
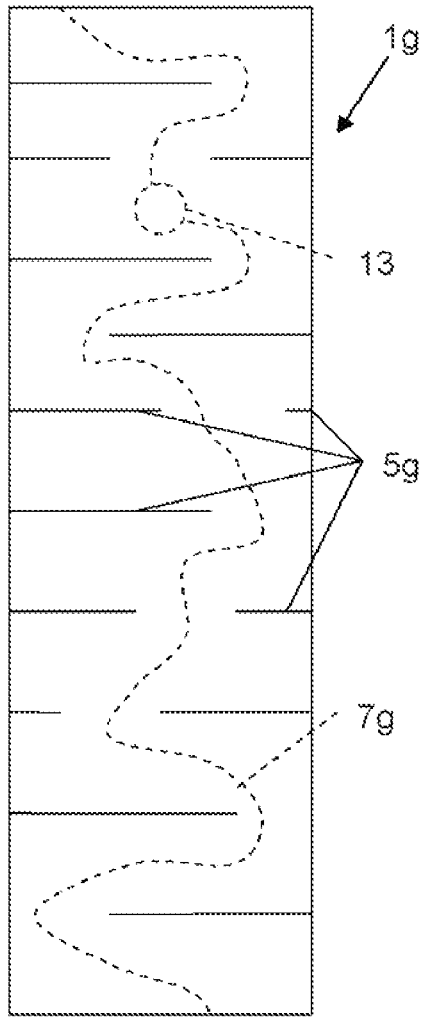

FIGS. 4A-4D show various embodiments of a wearable device 1*d*, 1*e*, 1*f* and 1*g* respectively, with different track arrangements. In these embodiments, the shape and orientation of closure lines 5*d*, 5*e*, 5*f*, and 5*g* creates tracks 7*d*, 7*e*, 7*f*, and 7*g* respectively, of different shapes. In the device 1*d* shown in FIG. 4A, the closure lines 5*d* are substantially straight lines, with some being oriented in the direction of the circumference of the loop 6*d* and some being oriented at right angles to the circumference of the loop. The device 1*e* shown in FIG. 4B is similar to that of FIG. 4A, but the loop 6*e* has a track 7*e* defined in part by curved closure lines 5*e*. In the device if shown in FIG. 4C, the loop 6*f* has a track 7*f* with closure lines 5*f* constructed in a pattern that creates areas in which the object 13 may not be manipulated such that the areas form obstacles in the track. In the device 1*g* shown in FIG. 4D, the loop 6*g* has a track 7*g* with closure lines 5*g* constructed to create a track with an irregular, non-repeating pattern. It will be appreciated that a virtually infinite variety of closure line orientations may be used.

Figure 5A:
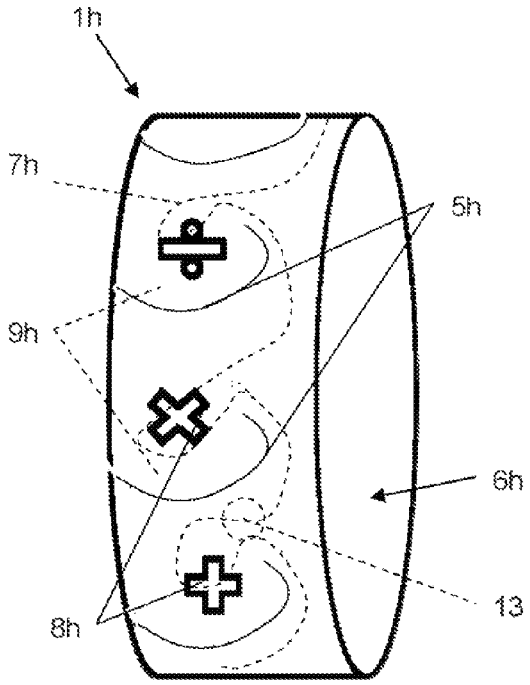
FIGS. 5A-5B schematically shows a wearable device according to a fifth aspect of the invention.
Figure 5B:
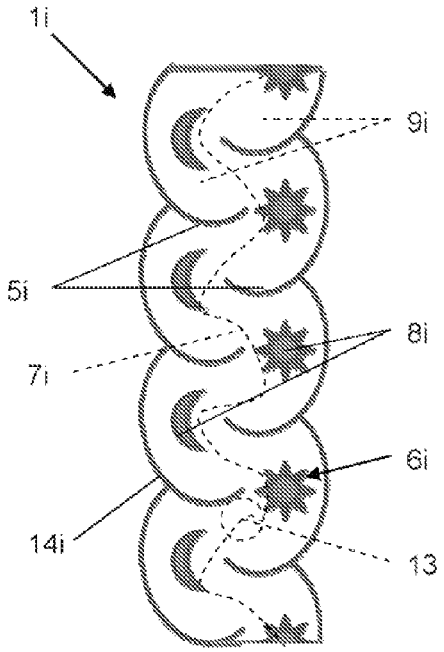

FIGS. 5A-5B show embodiments of a wearable device 1*h* and 1*i*, respectively, with separate labeled sections 9*h* and 9*i*, respectively, that may be used for a variety of purposes. The device 1*h* of FIG. 5A, for example, comprises a loop 6*h* having a track 7*h* (shown in phantom) with curved closure lines 5*h* that create sections or internal pockets or chambers 9*h* (shown in phantom) along the track into and out of which the object 13 (shown in phantom) may be moved. As shown, the pockets or chambers 9*h* or other portions of the device 1*h* may be labeled with labels 8*h*, such as in the form of symbols, that may be used, for example, to track a factor within a game.

The wearable device 1*i* of FIG. 5B similarly involves a loop 6*i* having a track 7*i* (shown in phantom) with closure lines 5*i* that create a plurality of defined sections 9*i* (shown in phantom) along the track into and out of which the object 13 (shown in phantom) may be moved. The sections 9*i* may have labels 8*i*, such as in the form of symbols. These symbols may be unique or, as in FIG. 5B, repeated along the track 7*i*. It will be appreciated that other closure line orientations and labels may be used. Edges 14*i* of the loop 6*i* may have a variety of forms, such as the scalloped shape shown in FIG. 5B.

Figure 6A:
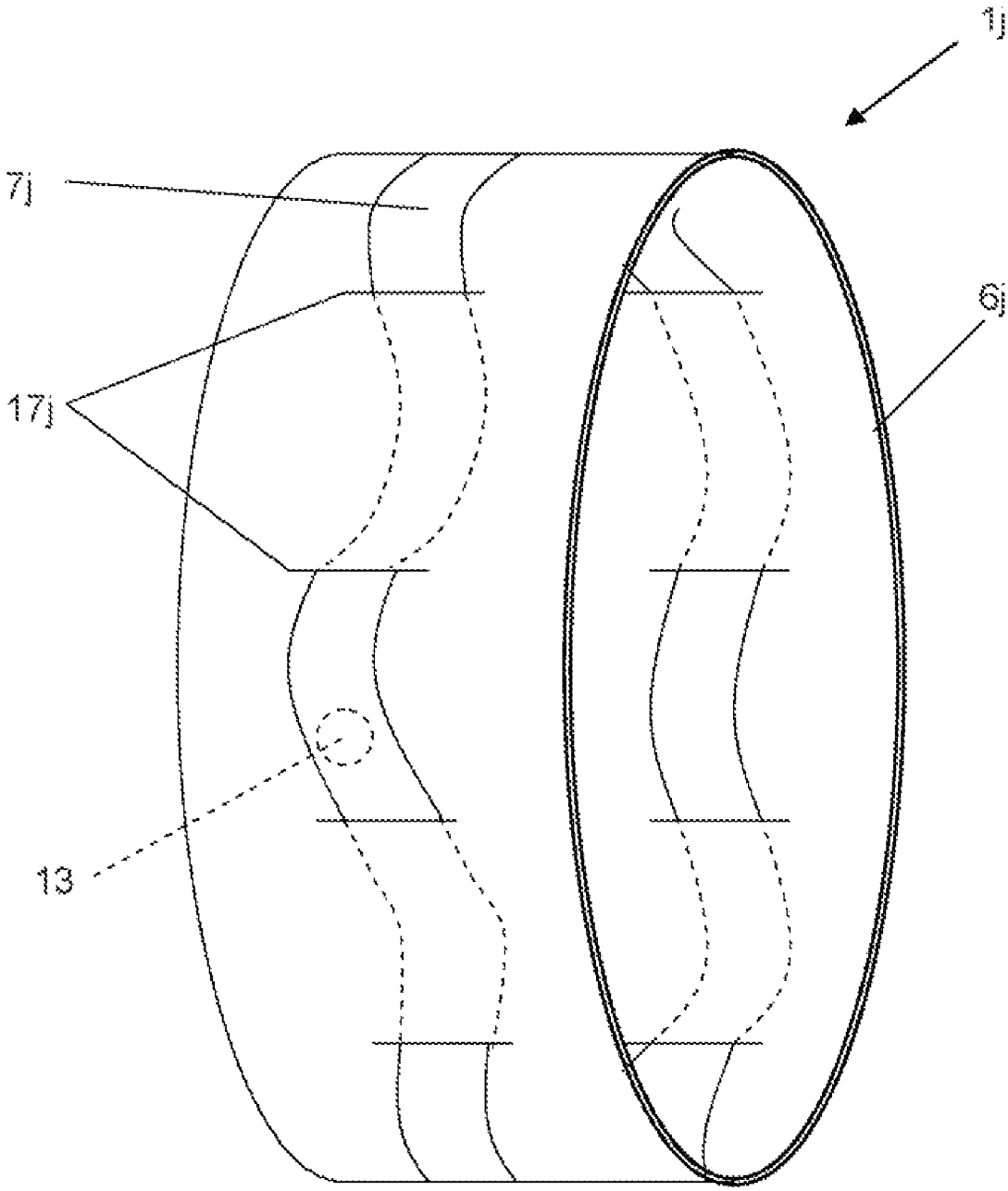
FIG. 6A schematically shows a wearable device according to a sixth aspect of the invention.

FIG. 6A shows an embodiment of the invention in which a tubular, annular track 7*j* is woven in and out of slits 17*j* in an annular loop 6*j*. As illustrated, the object 13 is placed inside the track 7*j* through which it can be manipulated. A second annular track (not shown) may be woven through the slits 17*j* in the same manner as the annular track 7*j*, or in a reverse manner, i.e., so that the second track is outside the loop 6*j* when the first annular track is inside, and vice versa. The annular track might also extend around the loop 6*j* more than once.

Figure 6B:
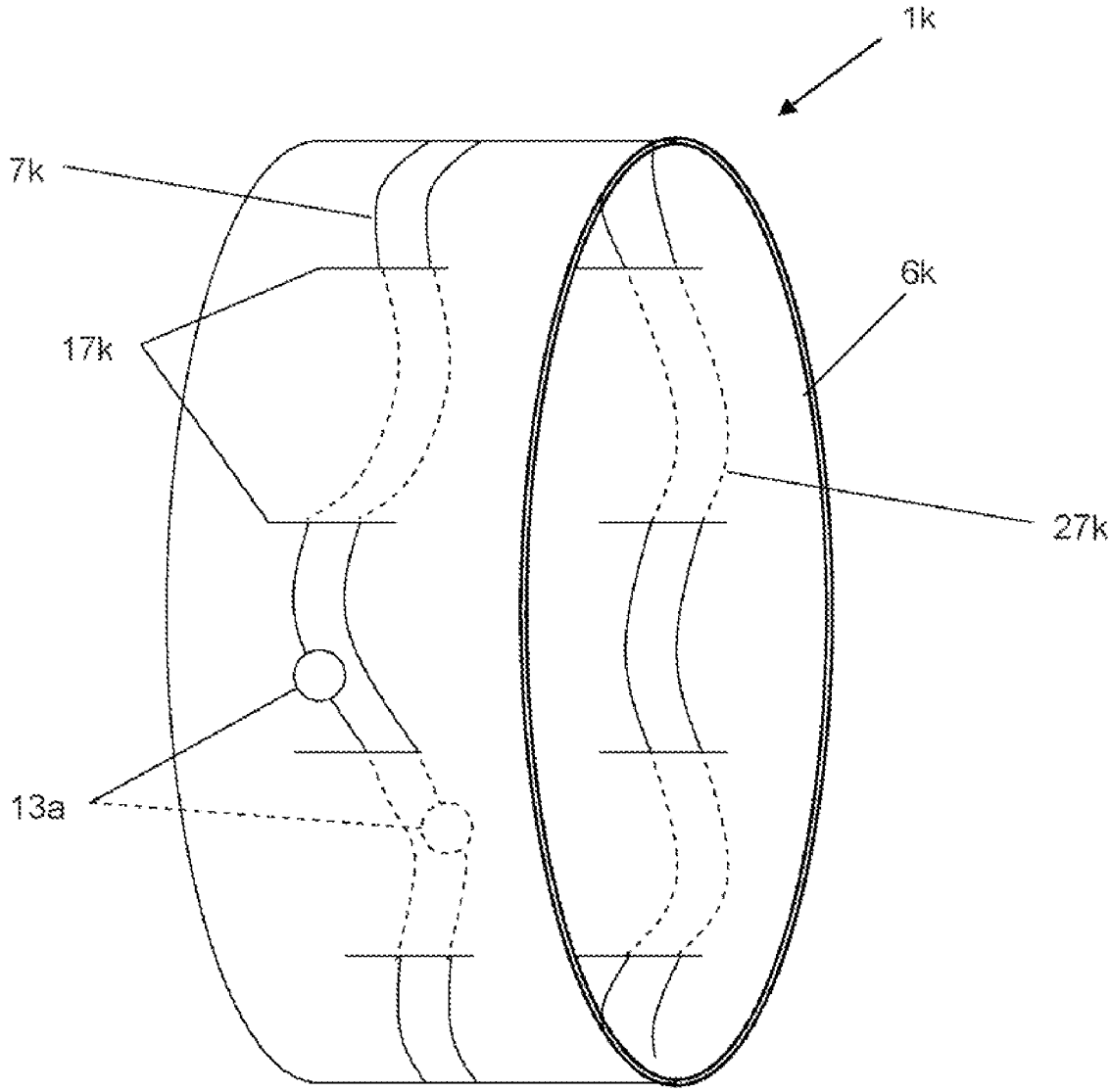
FIG. 6B schematically shows a wearable device according to a seventh aspect of the invention.

FIG. 6B shows an alternative embodiment in which an annular track 7*k* is woven in and out of slits 17*k* in an annular loop 6*k*. The object 13*a* is secured around the track 7*k* and can be manipulated along the track 7*k* around the loop 6*k*. FIG. 6B also shows a second annular track 27*k* (shown in phantom) that can be provided. The second annular track 27*k* (shown in phantom) may be woven through the slits 17*k* in the same manner as the annular track 7*k*, or in a reverse manner, i.e., so that the track 27*k* is on an outside of the loop 6*k* when the track 7*k* is on an inside, and vice versa. A track that loops around the loop more than once might also be provided.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A wearable device comprising:

one or more pieces of pliable fabric material at least partially forming a generally tubular track and a cylindrical loop, wherein the track is partially closed at one or more locations by one or more closure lines; and an object disposed in the track and adapted to be manipulated through the track around the one or more closure lines.

2. The wearable device of claim 1, wherein the track is endless.

3. The wearable device of claim 1, wherein the track has a starting point and ending point.

4. The wearable device of claim 3, wherein the starting point and ending point are at the same location.

5. The wearable device of claim 1, wherein the object is adapted to be manipulated in multiple directions along the track.

6. The wearable device of claim 1, wherein the track comprises a plurality of labeled sections.

7. The wearable device of claim 6, wherein the track comprises pockets, at least some of the labeled sections identifying the pockets.

8. The wearable device of claim 1, wherein the object is visible or emits a sound that is audible through one or more pieces of pliable material.

9. A wearable device comprising:

a loop made of a pliable, fabric material, the loop at least partially forming a track, the track being separated into a plurality of labeled sections; and an object externally and movably mounted on the track, the object being movable to each of the labeled sections.

10. The wearable device of claim 9, wherein the track is endless.

11. The wearable device of claim 9, wherein track has a starting point and ending point.

12. The wearable device of claim 11, wherein the starting point and ending point are at the same location.

13. The wearable device of claim 9, wherein the object grips the track and is movable upon application of a force sufficient to overcome a force with which the object grips the track.

14. The wearable device of claim 9, comprising a second loop, the second loop being cylindrical and having a plurality of openings, the first loop being woven through the plurality of openings.

15. A wearable device comprising:

a first loop at least partially forming a track;

an object on the track and adapted to be manipulated along the track; and a second loop, the second loop having a plurality of openings, the first loop being woven through the plurality of openings.

16. The wearable device of claim 15, wherein the first loop is tubular and the object is disposed inside the tubular loop.

17. The wearable device of claim 15, wherein the object is mounted to an exterior of the first loop.

18. The wearable device of claim 15, wherein the second loop is cylindrical.

19. The wearable device of claim 15, comprising labels identifying different portions of the track.

20. The wearable device of claim 15, wherein the track is endless.

* * * * *